US008367461B2

(12) United States Patent
Kuegler et al.

(10) Patent No.: US 8,367,461 B2
(45) Date of Patent: Feb. 5, 2013

(54) FUNCTIONAL MATERIAL FOR PRINTED ELECTRONIC COMPONENTS

(75) Inventors: Ralf Kuegler, Cambridge, MA (US); Joerg Schneider, Seeheim-Jugenheim (DE); Rudolf Hoffmann, Darmstadt (DE)

(73) Assignee: Merck Patent GmbH, Darmstadt (DE)

( * ) Notice: Subject to any disclaimer, the term of this patent is extended or adjusted under 35 U.S.C. 154(b) by 224 days.

(21) Appl. No.: 12/669,239

(22) PCT Filed: Jun. 17, 2008

(86) PCT No.: PCT/EP2008/004876

§ 371 (c)(1),
(2), (4) Date: Jan. 15, 2010

(87) PCT Pub. No.: WO2009/010142

PCT Pub. Date: Jan. 22, 2009

(65) Prior Publication Data

US 2010/0181564 A1 Jul. 22, 2010

(30) Foreign Application Priority Data

Jul. 17, 2007 (DE) ..... 10 2007 033 172
Sep. 14, 2007 (DE) ..... 10 2007 043 920

(51) Int. Cl.
*H01L 21/00* (2006.01)

(52) U.S. Cl. ..... 438/104; 257/E21.461; 257/E29.094

(58) Field of Classification Search ..... 257/E29.094, 257/E21.461; 438/104; 427/98.4; 556/118
See application file for complete search history.

(56) References Cited

U.S. PATENT DOCUMENTS

| | | | | |
|---|---|---|---|---|
| 6,503,831 | B2 * | 1/2003 | Speakman | 438/674 |
| 2003/0122122 | A1 | 7/2003 | Iwata | |
| 2005/0009224 | A1 * | 1/2005 | Yang et al. | 438/57 |
| 2006/0284171 | A1 | 12/2006 | Levy et al. | |

FOREIGN PATENT DOCUMENTS

| | | | |
|---|---|---|---|
| DE | 198 51 703 | A1 | 5/2000 |
| EP | 1 324 398 | A2 | 7/2003 |
| WO | WO 2006/138071 | A1 | 12/2006 |

OTHER PUBLICATIONS

International Search Report of PCT/EP2008/004876 (Dec. 11, 2008).
J. T. Anderson et al., "Solution-Processed Oxide Films, Devices, and Integrated Circuits", Mater. Res.Soc. Symp. Proc., vol. 988 (2007).
Y. S. Wang et al., "Nanocrystalline ZnO with Ultraviolet Luminescence", J. Phys. Chem. B, vol. 110 (2006) pp. 4099-4104.
A. J. Petrella et al., "Single-Source Chemical Vapor Deposition Growth of ZnO Thin Films Using $Zn_4O(CO_2Net_2)_6$", Chem. Mater., vol. 14 (2002) pp. 4339-4342.
M. R. Hill et al., "Towards New Precursors for ZnO Thin Films by Single Source CVD: The X-Ray Structures and Precursor Properties of Zinc Ketoacidoximates", Inorganica Chimica Acta, vol. 358 (2005) pp. 201-206.

* cited by examiner

*Primary Examiner* — Lex Malsawma
(74) *Attorney, Agent, or Firm* — Millen, White, Zelano, Branigan, P.C.

(57) ABSTRACT

The invention relates to a printable precursor comprising an organometallic zinc complex which contains at least one ligand from the class of the oximates and is free from alkali metals and alkaline-earth metals, for electronic components and to a preparation process. The invention furthermore relates to corresponding printed electronic components, preferably field-effect transistors.

15 Claims, 3 Drawing Sheets

FUNCTIONAL MATERIAL FOR PRINTED ELECTRONIC COMPONENTS

Figure 1:
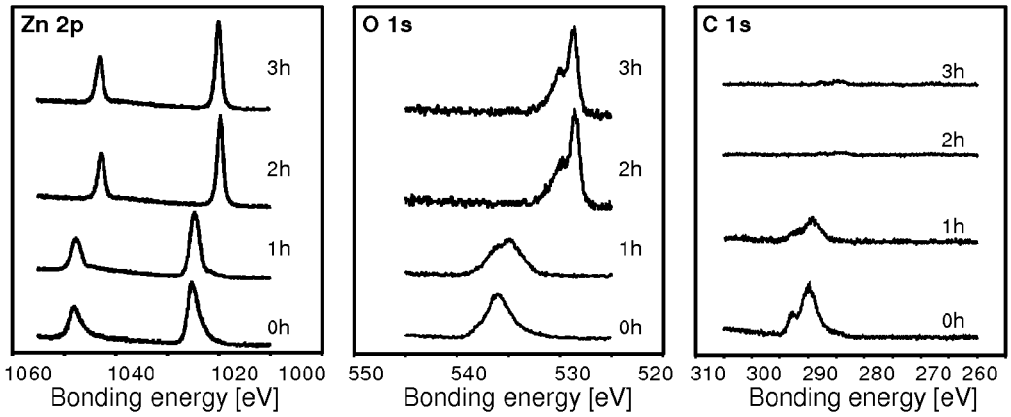

The invention relates to a zinc complex-containing precursor for electronic components and to a preparation process. The invention furthermore relates to corresponding printed electronic components and to a production process.

For use of printed electronics in mass applications (for example RFID (=radio frequency identification) chips on individual packaging), the use of established mass printing processes is desirable. In general, printed electronic components and systems consist of a plurality of material components, such as conductors for, for example, contacts, semiconductors, for example as active materials, and insulators, for example as barrier layers.

The production processes usually consist of a deposition step, i.e. application of the particular material to a support material (substrate), and a subsequent process step which ensures the desired properties of the material. With respect to mass-compatible, for example roll-to-roll, processing, the use of flexible substrates (films) is desirable. Previous processes for the production of printed circuits have intrinsic advantages, but also disadvantages:

Conventional technology (see WO 2004086289): Here, hybrids of conventional Si logic component and additional structured or printed components (for example metal antenna in the case of RFID chip) are assembled at high cost. However, this process is regarded as too complex with respect to a real volume application.

Organic materials (see DE 19851703, WO 2004063806, WO 2002015264): These systems comprise printed electronic components based on polymers from the liquid phase. These systems are distinguished by simple processing from solutions compared with the materials mentioned above (conventional technology). The only process step to be taken into account here is drying of the solvent. However, the achievable performance in the case of, for example, semiconducting or conducting materials is restricted by limiting material-typical properties, such as, for example, charge-carrier mobility <10 $cm^2/Vs$ due to so-called hopping mechanisms. This restriction affects the potential applications: the performance of a printed transistor increases with reduced size of the semiconducting channel, which can currently not be printed smaller than 40 μm by mass processes. A further restriction of the technology is the sensitivity of the organic components to ambient conditions. This causes a complex procedure during production and possibly a shortened lifetime of the printed components.

Inorganic materials: Due to different intrinsic properties (for example charge-carrier transport in the crystal), this class of materials generally has the potential for increased performance compared with organic materials on use in printed electronics.

In this area, two different approaches can in principle be used:

i) Preparation from the gas phase without an additional process step: in this case, it is possible to produce very well oriented, thin layers of high charge-carrier mobility, but the associated high-cost vacuum technology and the slow layer growth limit application in the mass market.

ii) Wet-chemical preparation starting from precursor materials, where the materials are applied from the liquid phase, for example by spin coating or printing (see U.S. Pat. No. 6,867,081, U.S. Pat. No. 6,867,422, US 2005/0009225). In some cases, mixtures of inorganic materials and organic matrix are also used (see US 2006/0014365).

In order to ensure a continuous electrical property of the layer produced, a process step is generally necessary which goes beyond evaporation of the solvent: in all cases, it is necessary to produce a morphology with coalescing regions, where precursors from the wet phase are additionally converted into the desired active material. A desired functionality is thus produced (in the case of semiconductors: high charge-carrier mobility). The processing is therefore carried out at temperatures >300° C., but this prevents use of this process for film coating.

An example of the use of a precursor material is described in Inorganica Chimica Acta 358 (2005)201-206. Here, zinc ketoacid oximates are employed for the preparation of zinc oxide by thermal decomposition. The reaction temperature depends on the structure of the ketoacid oximate ligand. Low conversion temperatures (~120° C.) are employed for the preparation of nanoscale zinc oxide particles. By contrast, higher decomposition temperatures (>250° C.) make use in gas-phase processes (CVD) appear possible. The synthesis is carried out using an alkali metal salt, whose alkali metal ions may have an adverse effect on the electronic properties as residues in the Zn complex and further in the ZnO produced.

A further example of the use of a soluble ZnO precursor material is described in WO 2006138071. ZnO precursors mentioned here are zinc acetate, zinc acetylacetonate, zinc formate, zinc hydroxide, zinc chloride and zinc nitrate. The relatively high decomposition temperatures (>200° C.) of the materials prepared and the tendency to sublime have a disadvantageous effect in this process. Furthermore, the formation of crystallites during the conversion reduces film formation on substrates and thus the adhesion of the materials to the substrate and the homogeneity of the surface.

EP 1 324 398 describes a process for the production of a metal oxide-containing, thin film having semiconductor properties, consisting of at least one step for adhesion of an organometallic zinc solution (such as, for example, zinc acetate) containing oxygen and a solvent to a substrate and at least one decomposition step of the organometallic solution by thermal treatment. The same disadvantages as in WO 2006138071 also occur in this process.

These conventional processes for the production of printed circuits are restricted in their applicability in volume production to a mass printing application.

The object of the present invention was therefore to provide inorganic materials whose electronic properties can be adjusted on the one hand by the material composition and on the other hand by the process for the preparation of the printed materials. To this end, the aim is to develop material systems which retain the advantages of inorganic materials. It should be possible to process the material from the wet phase by a printing process. The electronic performance of the material that is desired in each case on planar and flexible substrates should be produced using a process step which requires only low input of energy.

Surprisingly, a process has now been developed in which a novel organo-metallic precursor material is prepared, applied to surfaces and subsequently converted into the electrically active, i.e. conductive, semiconducting and/or insulating material at low temperatures. The layers produced here are distinguished by surface properties which are advantageous for a printing process.

The present invention thus relates to a precursor for coating electronic components, characterised in that it comprises an organometallic zinc complex which contains at least one ligand from the class of the oximates and is free from alkali and alkaline-earth metals.

The term "free from alkali and alkaline-earth metals" means that the alkali or alkaline-earth metal content in the zinc complex prepared is less than 0.2% by weight.

The preparation of alkali metal-free starting compounds is crucial for use in electronic components since residues containing alkali metals and alkaline-earth metals have an adverse effect on the electronic properties. These elements act as foreign atoms in the crystal and may have an unfavourable influence on the properties of the charge carriers.

In a preferred embodiment, the precursor is printable and is in the form of a printing ink or printing paste for coating printed field-effect transistors (FETs), preferably thin-film transistors (TFTs).

The term "printable precursor" is taken to mean a precursor material which, owing to its material properties, is capable of being processed from the wet phase by a printing process.

The term "field-effect transistor (FET)" is taken to mean a group of unipolar transistors in which, in contrast to bipolar transistors, only one charge type is involved in current transport—the electrons or holes, or defect electrons, depending on the design. The most widespread type of FET is the MOSFET (metal oxide semiconductor FET).

The FET has three connections:

source gate drain.

In the MOSFET, a fourth connection bulk (substrate) is also present. This is already connected internally to the source connection in individual transistors and is not wired separately.

In accordance with the invention, the term "FET" generally encompasses the following types of field-effect transistor:

junction field-effect transistor (JFET)

Schottky field-effect transistor (MESFET)

metal oxide semiconductor FET (MOSFET)

high electron mobility transistor (HEMT)

ion-sensitive field-effect transistor (ISFET)

thin-film transistor (TFT).

In accordance with the invention, preference is given to the TFT, with which large-area electronic circuits can be produced.

As already described above, the precursor contains, as organometallic zinc complex, at least one ligand from the class of the oximates. It is preferred in accordance with the invention for the ligand of the zinc complex to be a 2-(methoxyimino)alkanoate, 2-(ethoxyimino)alkanoate or 2-(hydroxyimino)-alkanoate.

The present invention furthermore relates to a process for the preparation of a precursor, characterised in that at least one oxocarboxylic acid is reacted with at least one hydroxylamine or alkylhydroxylamine in the presence of an alkali metal-free base, and an inorganic zinc salt, such as, for example, zinc nitrate, is subsequently added.

The starting compounds employed for thin layers of zinc oxide are in accordance with the invention zinc complexes containing oximate ligands. The ligands are synthesised by condensation of alpha-keto acids or oxocarboxylic acids with hydroxylamines or alkylhydroxylamines in the presence of bases in aqueous solution. The precursors or zinc complexes form at room temperature after addition of a zinc salt, such as, for example, zinc nitrate.

The oxocarboxylic acids employed can be all representatives of this class of compounds. However, preference is given to the use of oxoacetic acid, oxopropionic acid or oxobutyric acid.

The alkali metal-free base employed is preferably alkylammonium hydro-gencarbonate, alkylammonium carbonate or alkylammonium hydroxide. Particular preference is given to the use of tetraethylammonium hydroxide or tetraethylammonium bicarbonate. These compounds and the by-products forming therefrom are readily soluble in water. They are thus suitable on the one hand for carrying out the reaction for the preparation of the precursors in aqueous solution, and on the other hand the by-products forming can easily be separated off from the precursors by recrystallisation.

The present invention furthermore relates to a printed electronic component which has the following thin layers:

a rigid or flexible, conductive substrate or an insulating substrate having a conductive layer (gate)

an insulator at least one electrode (drain electrode)

at least one zinc oxide layer having insulating and/or semiconducting and/or conductive properties which is free from alkali metals and alkaline-earth metals, obtainable from the precursor according to the invention.

In a preferred embodiment, the electronic component (see FIG. 3) consists of a field-effect transistor or thin-film transistor which consists of a high-n-doped silicon wafer with a layer of $SiO_2$, to which gold electrodes have been applied with an interlayer as adhesion promoter. The gold electrodes have an interdigital structure in order to achieve a favourable ratio of channel width and length.

The semiconducting zinc oxide layer is applied to the substrate by means of spin coating.

In a further preferred embodiment, the electronic component consists of a field-effect transistor or thin-film transistor whose gate consists of a high-n-doped silicon wafer, a high-n-doped silicon thin layer, conductive polymers, metal oxides or metals, in the form of a thin layer or substrate material depending on the design. Depending on the design, the thin layers may have been applied below (bottom gate) or above (top gate) the semiconducting or insulating layer in the arrangement. The gate is applied in a structured or unstructured manner by means of spin coating, dip coating, flexographic/gravure printing, ink-jet printing and deposition techniques from the gaseous or liquid phase.

In a further preferred embodiment, the electronic component consists of a field-effect transistor or thin-film transistor whose source and drain electrodes consist of a high-n-doped silicon thin layer, conductive polymers, metal oxides or metals, in each case in the form of a thin layer. Depending on the design, the thin layers may have been applied below (bottom contact) or above (top contact) the semiconducting or insulating layer in the arrangement.

The electrodes are applied in a structured manner by means of flexo-graphic/gravure printing, ink-jet printing and deposition techniques from the gaseous or liquid phase.

In a further preferred embodiment, the electronic component consists of a field-effect transistor or thin-film transistor whose insulating layer consists of silicon dioxide, silicon nitride, insulating polymers or metal oxides. The insulator layer is applied in a structured or unstructured manner by means of spin coating, dip coating, flexographic/gravure printing, ink-jet printing and deposition techniques from the gaseous or liquid phase.

In a preferred embodiment, the zinc oxide layer or surface is non-porous, and therefore closed, and thus preferably acts as a smooth interface to further following layers.

The zinc oxide layer has a thickness of 15 nm to 1 μm, preferably 30 nm to 750 nm. The layer thickness is dependent on the coating technique used in each case and the parameters thereof. In the case of spin coating, these are, for example, the speed and duration of rotation.

For the electronic performance of ZnO layers produced by spin coating, values $>10^{-3}$ $cm^2/Vs$ arise in accordance with the invention for the charge-carrier mobility at an FET threshold voltage of 18 volts. The reproducible experimental conditions under which the measurements are carried out, namely under inert conditions (oxygen <5 ppm, atmospheric humidity <10 ppm), are important in this connection.

In accordance with the invention, FET threshold voltages <30 V were measured.

In accordance with the invention, the substrate can be either a rigid substrate, such as glass, ceramic, metal or a plastic substrate, or a flexible substrate, in particular plastic film or metal foil. In accordance with the invention, preference is given to the use of a flexible substrate (film or foil).

The present invention furthermore relates to a process for the production of electronic structures having an insulating and/or semiconducting and/or conductive zinc oxide layer or surface, characterised in that a) precursor solutions of the organometallic zinc complex according to the invention are applied to a substrate in a layered manner, optionally one or more times, corresponding to the electronic structure to be achieved, by dip coating, spin coating or ink-jet printing or flexographic/gravure printing,
b) calcination or drying of the applied precursor layer in air or oxygen atmosphere with formation of a zinc oxide layer or surface,
c) the applied electronic structure can finally be sealed with an insulating layer and is provided with contacts and completed.

This process produces both electronic components and also the connections of individual components in integrated circuits.

The application of the precursor solutions according to the invention to the substrate by processes such as dip coating, spin coating and ink-jet printing or flexographic/gravure printing is known to the person skilled in the art (see M. A. Aegerter, M. Menning; Sol-Gel Technologies for Glass Producers and Users, Kluwer Academic Publishers, Dordrecht, Netherlands, 2004), where ink-jet printing or flexographic/gravure printing is preferred in accordance with the invention.

The thermal conversion of the zinc complex precursor into the functional zinc oxide layer having insulating, semiconducting and/or conductive properties is carried out at a temperature ≧80° C. The temperature is preferably between 150 and 200° C.

The conversion of the zinc complex precursor into the functional zinc oxide layer having insulating, semiconducting and/or conductive properties is carried out in a further preferred embodiment by irradiation with UV light at wavelengths <400 nm. The wavelength is preferably between 150 and 380 nm. The advantage of UV irradiation is that the ZnO layers produced thereby have lower surface roughness. Increased roughness of the surfaces would mean an increased risk that the thin subsequent layers could not be formed homogeneously and thus would not be electrically functional (for example short-circuit by a damaged dielectric layer).

Finally, the functional zinc oxide layer can be sealed with an insulating layer. The component is provided with contacts and completed in a conventional manner.

The present invention furthermore relates to the use of the organometallic zinc complex or precursor according to the invention for the production of one or more functional layers in the field-effect transistor.

The following examples are intended to illustrate the present invention. However, they should in no way be regarded as limiting. All compounds or components which can be used in the compositions are either known and commercially available or can be synthesised by known methods.

EXAMPLE 1

Alkali or Alkaline-Earth Metal-Free Preparation of the Zinc Oxide Precursor Bis[2-(Methoxyimino)Propanoato]Zinc Tetraethylammonium bicarbonate (22.94 g, 120 mmol) is added in small portions with stirring to a solution of 2-oxopropanoic acid (=pyruvic acid) (5.28 g, 60 mmol) and methoxylamine hydrochloride (5.02 g, 60 mmol) in 20 ml of water. When the visible evolution of gas is complete, the mixture is stirred for a further two hours. Zinc nitrate hexahydrate (8.92 g, 30 mmol) is subsequently added, and, after four hours, the mixture is cooled to 5° C. The white precipitate which has formed is filtered off and recrystallised from hot water. Yield 5.5 g (56.7%).

EXAMPLE 2

Preparation of Undoped Zinc Oxide from the Zinc Oxide Precursor (from Example 1) Having Semiconductor Properties The bis[2-(methoxyimino)propanoato]zinc prepared in accordance with Example 1 is applied to a substrate made of glass, ceramic or polymers, such as PET, by means of spin coating (or dip coating or even ink-jet printing). The zinc complex is subsequently heated in air for 2 h at a temperature of 150° C. (see FIG. 1). The zinc oxide films obtained in this way exhibit a uniform, crack-free, non-porous surface morphology. The layers consist of zinc oxide crystallites, whose sizes are dependent on the calcination temperature. They have semiconductor properties.

EXAMPLE 3

Preparation of Undoped Zinc Oxide from the Zinc Oxide Precursor (from Example 1) Having Semiconductor Properties by Means of UV Exposure The bis[2-(methoxyimino)propanoato]zinc prepared in accordance with Example 1 is applied to a substrate made of glass, ceramic or polymers, such as PET, by means of spin coating (or dip coating or even ink-jet printing). The zinc complex is subsequently converted into zinc oxide by irradiation with UV light from an Fe arc lamp for 1 h (irradiation strength 150 to 200 $mW/cm^2$) in air. The zinc oxide films obtained in this way, as in Example 2, exhibit a uniform, crack-free, non-porous surface morphology, which additionally has very low surface roughness. The layers consist of zinc oxide crystallites and have comparable semiconductor properties as in Example 2.

EXAMPLES 4 TO 6

Description of Various Coating Processes

In all cases, solutions of 10% by weight of bis[2-(methoxyimino)-propanoato]zinc in 2-methoxyethanol are used.

Dip coating: drawing speed ~1 mm/sec. The substrates employed are 76×26 mm glass plates.

Spin coating: For the spin coating, 150 μl of solution are applied to the substrate. The substrates used are 20×20 mm quartz or 15×15 mm silicon (with gold electrodes for the production of the FET). The parameters selected for duration and speed are 10 s at a preliminary speed of 1500 rpm and 20 s at the final speed of 2500 rpm.

Ink-jet printing: is carried out by means of a Dimatrix DMP 2811 printer.

INDEX OF FIGURES

The invention will be explained in greater detail below with reference to a number of working examples (see FIGS. 1 to 4).

FIG. 1: shows an analysis of the films according to the invention comprising bis[2-(methoxyimino)propanoato]zinc in methoxyethanol by dip coating on glass substrates and processing at 150° C. using various reaction times by means of X-ray photon spectroscopy (XPS). The XPS spectra allow information to be obtained on the elements present in the sample and their oxidation state, and on the mixing ratio. It can thus be shown that zinc oxide is present in the films after adequately long processing duration. Organic impurities (for example carbon and nitrogen) are below the detection limit of the method of about 0.2 mol %.

Figure 2:
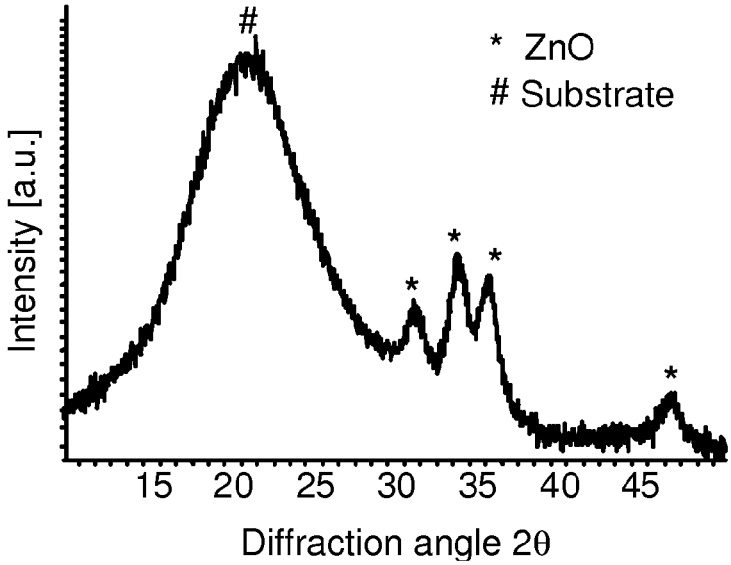

FIG. 2: shows an X-ray diffraction pattern (intensity plotted against diffraction angle 2 theta) of a film according to the invention comprising bis-[2-(methoxyimino)propanoato] zinc in methoxyethanol by spin coating on quartz substrate and processing at 150° C. The XRD pattern shows that, besides the substrate, zinc oxide having the wurzite structure is present as the only crystalline phase. Crystalline impurities are below the detection limit of about 2% by weight. The average crystallite size can be calculated as about 8 nm from the line broadening which is typical of a nanocrystalline material via the Scherrer formula.

Figure 3:
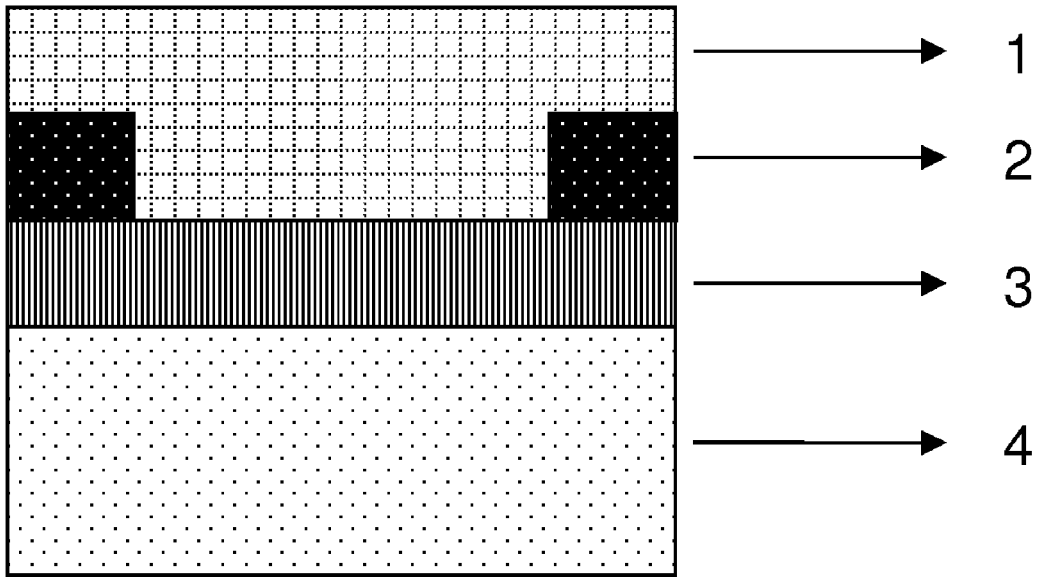

FIG. 3: shows a diagrammatic representation of the structure of a thin-film field-effect transistor according to the invention. (1=semiconductor zinc oxide; 2=drain, source gold, indium tin oxide; 3=insulator $SiO_2$; 4=substrate/gate silicon)

The component consists of a high-n-doped silicon wafer with a layer of $SiO_2$, to which gold electrodes are applied with an interlayer as adhesion promoter. The gold electrodes have an interdigital structure.

Figure 4:
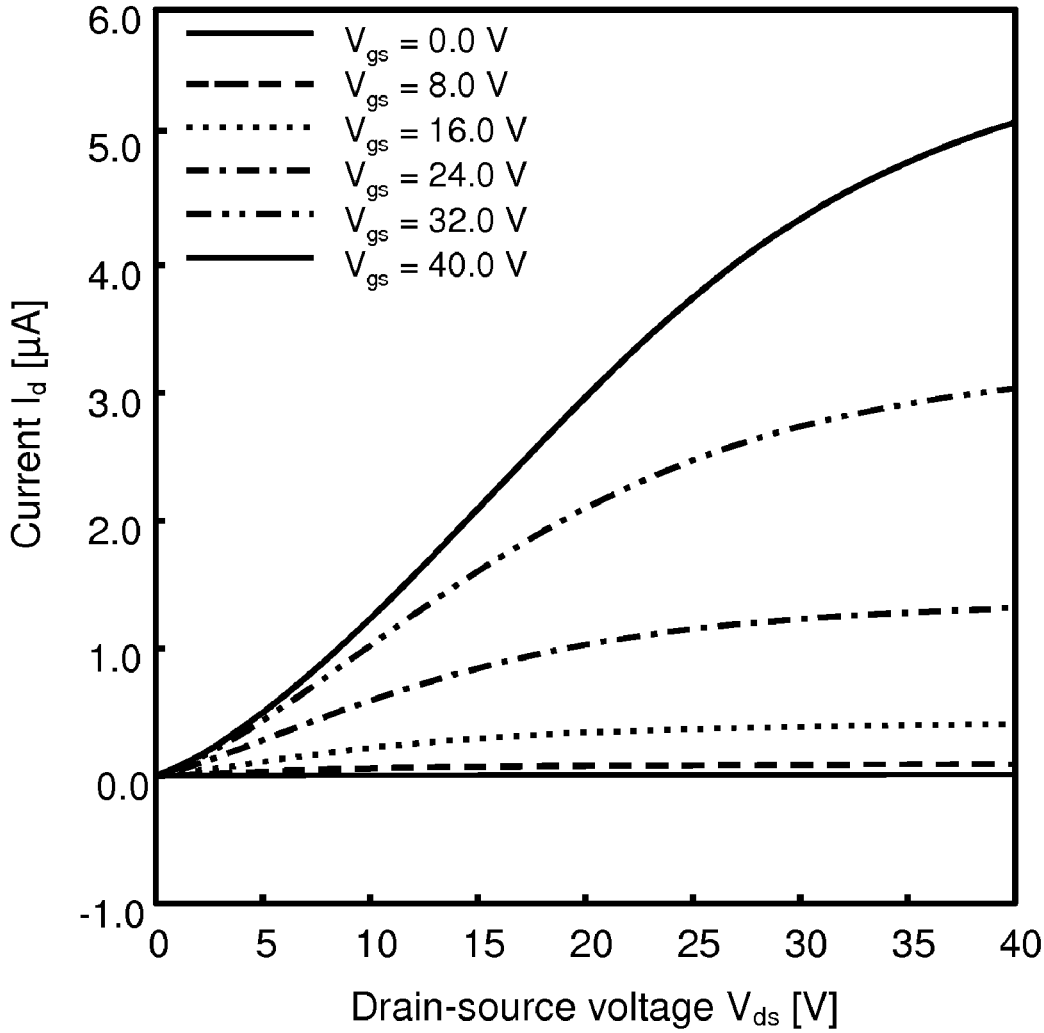

FIG. 4: shows a starting characteristic-line field for various gate-source voltages on variation of the drain-source voltage of a thin-film transistor (TFT) with semiconducting layer comprising the zinc oximate precursor according to the invention. The characteristic-line field shows the typical course for a semiconducting material. In addition, it allows extraction of important material parameters, in particular the charge-carrier mobility.

The invention claimed is:

1. A printable ink or paste precursor for coating electronic components, comprising an organometallic zinc complex which contains at least one ligand from the class of the oximates and is free from alkali metals and alkaline-earth metals, wherein said precursor is in a form suitable for printing on a printed field-effecttransistor (FET).

2. A printable ink or paste precursor according to claim 1, wherein the ligand is a 2-(methoxyimino)alkanoate, 2-(ethoxyimino)alkanoate or 2-(hydroxy-imino)alkanoate.

3. A printed, electronic component comprising the following thin layers:

a rigid or flexible conductive substrate or an insulating substrate having a conductive layer (gate)

an insulator at least one electrode (drain electrode)

at least one ZnO layer having insulating and/or semiconducting and/or conductive properties which is free from alkali metals and alkaline-earth metals, obtainable from a printable ink or paste precursor according to claim 1.

4. A printed, electronic component according to claim 3, wherein the zinc oxide layer is non-porous.

5. A printed, electronic component according to claim 3, wherein the substrate can be either a) a rigid glass, ceramic, metal or plastic substrate, or b) a flexible plastic film or metal foil.

6. A method according to claim 3, wherein said zinc oxide layer has a thickness of 15 nm to 1 μm.

7. A method according to claim 6, wherein said zinc oxide layer has a thickness of 30 nm to 750 nm.

8. A process for the preparation of a precursor according to claim 1, comprising reacting at least one oxocarboxylic acid with at least one hydroxylamine or alkylhydroxylamine in the presence of an alkali metal-free base, and subsequently adding an inorganic zinc salt.

9. A process according to claim 8, wherein the oxocarboxylic acid employed is oxoacetic acid, oxopropionic acid or oxobutyric acid.

10. A process according to claim 8, wherein the alkali or alkaline-earth metal-free base employed is an alkylammonium hydrogencarbonate, alkylammonium carbonate or alkylammonium hydroxide.

11. A process for the production of electronic structures having an insulating and/or semiconducting and/or conductive zinc oxide layer or surface, comprising a. applying a precursor solution of an organometallic zinc complex according to claim 1 to a substrate in a layered manner, optionally one or more times, corresponding to the electronic structure to be achieved, by dip coating, spin coating or ink-jet printing or flexographic/gravure printing, b. calcinating or drying of the applied precursor layer from step a) in air or oxygen atmosphere with formation of a zinc oxide layer or surface and c. sealing the applied electronic structure with an insulating layer and providing with contacts.

12. A process according to claim 11, wherein the calcination temperature T is ≧80° C.

13. A process according to claim 11, wherein the calcination or drying is carried out by irradiation with UV light at wavelengths <400 nm.

14. A process according to claim 11, wherein the zinc oxide layers are non-porous.

15. A method for the production of one or more functional layers in the field-effect transistor comprising applying printable ink or paste precursor according to claim 1.

* * * * *

UNITED STATES PATENT AND TRADEMARK OFFICE

CERTIFICATE OF CORRECTION

PATENT NO. : 8,367,461 B2
APPLICATION NO. : 12/669239
DATED : February 5, 2013
INVENTOR(S) : Kuegler et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 222 days.

Signed and Sealed this
First Day of September, 2015

Michelle K. Lee

Michelle K. Lee
*Director of the United States Patent and Trademark Office*